US011306516B2

(12) United States Patent
Borlodan

(10) Patent No.: US 11,306,516 B2
(45) Date of Patent: Apr. 19, 2022

(54) MOTOR VEHICLE LATCH

(71) Applicant: Kiekert AG, Heiligenhaus (DE)

(72) Inventor: Stelian Borlodan, White Lake, MI (US)

(73) Assignee: Kiekert AG, Heiligenhaus (DE)

( * ) Notice: Subject to any disclaimer, the term of this patent is extended or adjusted under 35 U.S.C. 154(b) by 701 days.

(21) Appl. No.: 16/218,713

(22) Filed: Dec. 13, 2018

(65) Prior Publication Data

US 2020/0190863 A1 Jun. 18, 2020

(51) Int. Cl.

| | |
|---|---|
| ***E05B 77/06*** | (2014.01) |
| ***E05B 79/08*** | (2014.01) |
| ***E05B 85/04*** | (2014.01) |
| ***E05B 79/10*** | (2014.01) |
| *E05B 85/26* | (2014.01) |

(52) U.S. Cl.

CPC ..... *E05B 77/06* (2013.01); *E05B 79/08* (2013.01); *E05B 79/10* (2013.01); *E05B 85/04* (2013.01); *E05B 85/26* (2013.01); *Y10S 292/22* (2013.01)

(58) Field of Classification Search

CPC ..... Y10S 292/22; E05B 77/06

See application file for complete search history.

(56) References Cited

U.S. PATENT DOCUMENTS

| | | | | |
|---|---|---|---|---|
| 3,799,596 | A * | 3/1974 | Nozomu | E05B 77/06 292/216 |
| 8,480,138 | B2 * | 7/2013 | Bendel | E05B 85/26 292/201 |
| 8,870,240 | B2 * | 10/2014 | Lee | E05B 77/06 292/57 |
| 9,611,676 | B2 * | 4/2017 | Bendel | E05B 79/10 |
| 2014/0035295 | A1 * | 2/2014 | Bendel | E05B 85/26 292/100 |
| 2014/0132008 | A1 * | 5/2014 | Bendel | E05B 77/06 292/92 |
| 2016/0258194 | A1 * | 9/2016 | Rosales | E05B 77/06 |

FOREIGN PATENT DOCUMENTS

| | | | | |
|---|---|---|---|---|
| DE | 19511651 | A1 * | 10/1995 | E05B 77/06 |
| DE | 102004008048 | A1 * | 9/2005 | E05B 81/04 |
| DE | 202008012949 | U1 * | 3/2010 | E05B 85/26 |

(Continued)

*Primary Examiner* — Carlos Lugo

(74) *Attorney, Agent, or Firm* — Renner, Otto, Boisselle & Sklar, LLP

(57) ABSTRACT

A motor vehicle latch, in particular a motor vehicle door latch, that in its basic structure is equipped with a locking mechanism essentially consisting of a catch and at least one pawl. Furthermore, an operating lever mechanism for the locking mechanism having at least one coupling lever and one release lever is realized. In its "coupled position," the coupling lever connects the release lever mechanically to the locking mechanism, and in its "uncoupled" position separates the release lever from the locking mechanism. In addition, an inertia element for guiding the coupling lever is provided. According to the invention, the inertia element has a guide contour for the coupling lever, which guide contour in a crash event separates the coupled coupling lever from the release lever and transfers the coupling lever to its "uncoupled" position without further mechanical contact.

19 Claims, 4 Drawing Sheets

(56) References Cited

FOREIGN PATENT DOCUMENTS

| | | | | | |
|---|---|---|---|---|---|
| DE | 202009009061 | U1 * | 12/2010 | ..... | E05B 77/06 |
| DE | 102009058751 | A1 * | 5/2011 | ..... | E05B 77/06 |
| DE | 102015109946 | A1 * | 12/2016 | ..... | E05B 77/06 |
| DE | 102016112182 | | 1/2018 | | |
| DE | 102017102899 | A1 * | 8/2018 | ..... | E05B 77/12 |
| WO | 2015090286 | | 12/2014 | | |
| WO | WO-2017182027 | A1 * | 10/2017 | ..... | E05B 83/36 |

* cited by examiner

MOTOR VEHICLE LATCH

The invention relates to a motor vehicle latch, in particular to a motor vehicle door latch, having a locking mechanism essentially made of a catch and at least one pawl, furthermore having an operating lever mechanism for the locking mechanism with at least one coupling lever and one release lever, wherein the coupling lever in its "coupled position" mechanically connects the release lever to the locking mechanism and in its "uncoupled" position separates the release lever from the locking mechanism, and having an inertia element for guiding the coupling lever.

As a rule, the motor vehicle latches described in the introduction are motor vehicle door latches, that is, for example, motor vehicle side door latches, motor vehicle hatchback latches, or motor vehicle front hood latches. In principle, however, the term motor vehicle latch may also include seat latches or the like.

With motor vehicle latches, and in particular with motor vehicle door latches, in principle there is the danger that in a crash event, that is, during an accident, with associated increased deceleration forces acting on the motor vehicle latch, the operating lever mechanism will be deflected in an undesired manner and the associated locking mechanism and thus a motor vehicle door will be opened. As a consequence thereof, safety measures provided in or on the motor vehicle door, such as, for example, a side airbag or a side impact protection element, may have practically no effect for vehicle occupants. For this reason, the state of the art is currently working with so-called inertia elements, which, in a crash event, initially remain at rest or are deflected only slightly, and interrupt the operating lever mechanism. Because of this, for example an outer door handle deflected in a crash event can no longer unintentionally open the locking mechanism.

The state of the art according to WO 2015/090286 A1 describes a locking device for a motor vehicle, which locking device is equipped with a coupling member and a release actuating lever for the latch mechanism. If the release actuating lever is operated starting from a starting position, the coupling member couples the release actuating lever to the release lever to open the lock mechanism. However, if the release actuating lever is accelerated excessively, the coupling member does not ensure that the release actuating lever is coupled to the release lever to open the lock. That is, when the coupling member or coupling lever is in the "uncoupled" position, the operating lever mechanism is interrupted in a crash event.

A release lever that, using a coupling lever, may be coupled to an actuating lever, is realized in the generic state of the art according to DE 10 2016 112 182 A1. Moreover, the coupling lever is guided using a control lever. For its part, the control lever is moved using a control contour of an inertia lever.

The state of the art has in principle been proven and tested. However, in practice problems may occur in that the coupling lever, when its coupled position is changed to the "uncoupled" position, may at least slightly act upon the release lever. As a consequence thereof, some indifferent functional statuses are possible that may prevent or impede assured mechanical separation of the operating lever mechanism. This is the case, for example, on long time scales, that is, with motor vehicle latches that have or may have soiling, corrosion, etc. due to a long period of usage without a crash event. In fact, in some circumstances, such impairments may also have a negative impact on proper functioning. This is where the invention is intended to provide a remedy.

The underlying technical problem of the invention is to refine such a motor vehicle latch such that the change in the functional positions of the coupling lever proceeds with no problem, and specifically without neutral functional conditions being found. This is also and in particular to be provided for long time scales.

For solving this technical problem, in a generic motor vehicle latch, and in particular a motor vehicle door latch, the invention suggests that the inertia element has a guide contour for the coupling lever, which guide contour, in a crash event, separates the coupled coupling lever from the release lever and, without further mechanical contact, transfers the release lever to its "uncoupled" position.

Thus, in the context of the invention, in particular the inertia element with its guide contour ensures that, in a crash event, the coupling lever is transferred from its prior "coupled" position, assumed during normal operation, to the "uncoupled" position. As a rule, when the coupling lever is in the "coupled" position, an actuating pin of the coupling lever abuts a support surface on the release lever. As soon as the coupling lever is acted upon, for instance via an outer actuating lever or inner actuating lever, the actuating pin, by acting on the support surface of the release lever during normal operation, ensures that the release lever is normally pivoted and in this way the locking mechanism opens. This is because the pivot movement of the release lever corresponds to the pawl being removed from its engagement with the catch when the locking mechanism is locked.

Here the invention initially proceeds from the understanding that the inertia element, at least at the beginning of the crash event, retains its undeflected position, the resting position and the position used during normal operation. As a consequence thereof, the guide contour may interact with the coupling lever. In this context, according to the invention the guide contour ensures not only that the coupling lever is mechanically separated from the release lever, but according to the invention the guide contour on the inertia element moreover ensures that the coupling lever, after the mechanical separation from the release lever in a crash event, is transferred to its "uncoupled" position without further mechanical contact with the release lever.

In this manner any indifferent functional conditions are prevented in the first place. This even holds true for the situation in which the inertia element is increasingly deflected during the interaction of the guide contour with the coupling lever in a crash event. This is because the guide contour on the inertia element is advantageously equipped with a lifting flank for a contour pin of the coupling lever for this purpose. Due to the interaction between the guide contour on the inertia element or its lifting flank and the guide pin of the coupling lever, what is attained overall is that at the beginning of the crash event the coupling lever is mechanically separated from the release lever, and during its movement it passes the release lever collision-free without mechanical contact and then assumes its "uncoupled" position. The same is true for the instance in which the inertia element is increasingly deflected during the crash event.

In fact, the lifting flank, as a component of the guide contour on the inertia element, advantageously ensures that during the transition of the coupled coupling lever into the "uncoupled" position the actuating pin that is on the coupling lever and that interacts with the support surface on the release lever is guided along the affected support surface of the release lever, and specifically with clearance. The interaction between the guide contour or its lifting flank on the inertia element and the contour pin of the coupling lever ensures overall that the locking mechanism always assumes and retains its locked position, specifically even if, during a crash event, the operating lever mechanism experiences a deflection due to the deceleration forces acting on it and, as a consequence thereof, the coupling lever is deflected.

This is because the deflection of the coupling lever, using the guide contour on the inertia element, is intentionally converted to the transition of the coupled coupling lever to its "uncoupled" position, and specifically without this involving or being able to involve mechanical contact with the release lever. Because of this, the interplay between the contour pin of the coupling lever and the guide contour on the inertia element may also be adjusted and defined such that the ultimate effect is that the temporal transition of the coupling lever from the "coupled position" to the "uncoupled" position may be influenced. That is, depending on the design of the contour pin and the guide contour, different velocities of the coupling lever during a crash event may be realized during the transition from the "coupled" position to the "uncoupled" position. In the state of the art to date this has not been possible, especially according to the invention explicitly in this process a mechanical contact between the coupling lever and the release lever is prevented, so that the "transition velocity" is ultimately determined solely by the design of the contour pin and the guide contour or its lifting flank. This is where the essential advantages are found.

According to one advantageous embodiment, an actuating spring that pre-stresses the coupling lever towards the guide contour on the inertia element is associated with the coupling lever. The actuating spring is in general embodied as a leg spring. The leg spring has a wound section and two legs. The wound section may be arranged wound about a swivel pin as a component of an actuating lever.

The two legs are in general a fixing leg and a clamping leg. The fixing leg of the actuating spring associated with the coupling lever is in general fixed on the actuating lever. In contrast, the free clamping leg can act on the coupling lever. In this context, the clamping leg works on a spring journal that is on the coupling lever and that is described in greater detail in the following.

In addition to the actuating spring on the actuating lever, in general a restoring spring is also provided that acts on the inertia element in the direction of its undeflected position. That is, the restoring spring ensures that the inertia element is transferred back to its undeflected position in a crash event and when it assumes a deflected position after the deceleration forces associated with the crash event have ceased. To this end, the restoring spring is advantageously embodied as a leg spring.

The wound section of the leg spring or restoring spring may surround a bearing journal of the inertia element pivotable about the bearing journal. One leg of the restoring spring is anchored in a lock housing, for example, while the other, free leg of the restoring spring ensures that the inertia element is acted upon in the direction of its undeflected position.

The coupling lever is in general arranged rotatable on the actuating lever addressed in the foregoing. To this end, the coupling lever has a pivot pin that engages in a corresponding bearing opening that is in the actuating lever and that accommodates the pivot pin. Moreover, the coupling lever has at least one pin that engages in a guide contour of the actuating lever. In general, in addition to the pivot pin rotatably engaging in the bearing opening of the actuating lever, two additional pins are provided on the coupling lever that jointly engage in the guide contour of the actuating lever. The two pins of the coupling lever ensure that, in a crash event, the coupling lever executes a guided pivot movement with respect to the actuating lever during the transition from the "coupled" position to the "uncoupled" position. The two pins on the coupling lever that engage in the guide contour on the actuating lever are a spring journal and a contour pin.

The spring journal interacts in general with the actuating spring, addressed in the foregoing, which pre-stresses the coupling lever towards the guide contour on the inertia element. In contrast, the contour pin is embodied and set up to interact with the guide contour and in particular with the lifting flank as a component of the guide contour, which has already been described in the foregoing.

In normal operation, this design is such that the coupling lever assumes its "coupled" position. This corresponds to the actuating pin on the coupling lever abutting the support surface of the release lever. The actuating pin on the coupling lever is normally arranged on a side of the coupling lever opposing the two guide pins and the pivot pin. Because the actuating pin of the coupling lever abuts the support surface of the release lever, in normal operation the operating lever mechanism being acted upon leads to, for instance, the coupling lever being acted upon via an outer actuating lever and/or inner actuating lever and itself deflecting the release lever in order in this manner to open the locking mechanism disposed in the lock position. In fact, the release lever here ensures that in general the pawl is disengaged from its engagement with the catch. As a consequence thereof, the catch opens, spring-loaded, and releases a previously captured striker. This is the usual functionality in normal operation. Here, the inertia element assumes its rest position or its undeflected position.

If there is a crash event, however, deceleration forces act on the operating lever mechanism. These deceleration forces lead to the actuating lever and also the coupling lever being deflected. Since the coupling lever is borne on the actuating lever and, in addition, the contour pin of the coupling lever in this case interacts with the guide contour on the inertia element, the interaction between the contour pin of the coupling lever and the guide contour or its lifting flank on the inertia element overall ensures that the coupled coupling lever is transferred to the "uncoupled" position.

Since in this process there is no further mechanical contact between the coupling lever and the release lever, because the actuating pin originally abutting support surface of the release lever in normal operation is guided along the support surface, with a clearance, during the transition to the "uncoupled" position, it is only the interplay between the guide contour on the inertia element and the contour pin of the coupling lever that determines the movement of the coupling lever and also any velocity during the transition from its "coupled" position to the "uncoupled" position. This is where essential advantages of the invention are found.

The invention shall be described in greater detail in the following by means of drawings illustrating merely one exemplary embodiment.

Figure 1A:
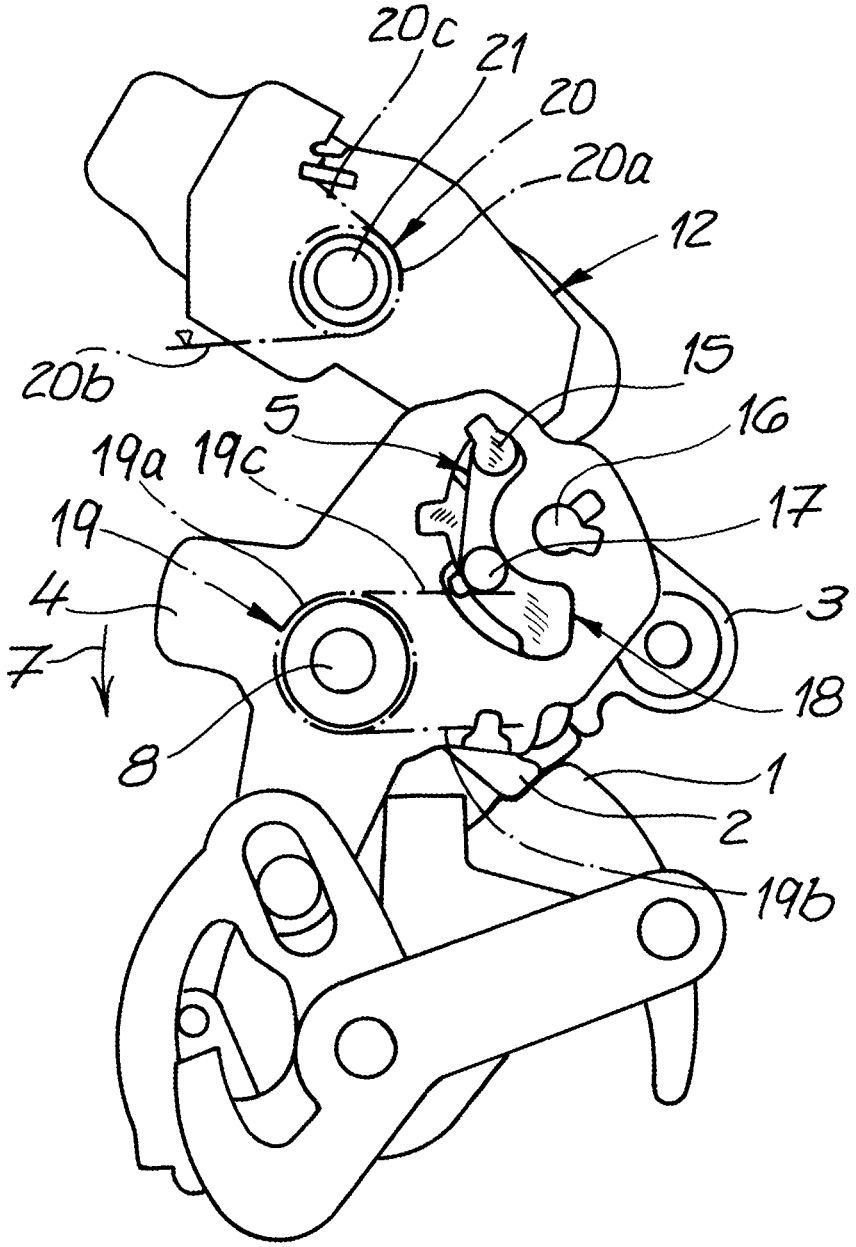
FIGS. 1A and 1B depict the inventive motor vehicle latch, reduced to the components essential to the invention during normal operation.

The figures depict a motor vehicle latch that is a motor vehicle door latch in the exemplary embodiment. The motor vehicle latch according to the invention is not limited to motor vehicle door latches. The motor vehicle door latch in question in this example is embodied as a motor vehicle side door latch. The motor vehicle door latch has a locking mechanism consisting essentially of a catch 1, a comfort pawl 2 and a pawl 3. According to the exemplary embodiment, but not being limited thereto, the locking mechanism is embodied as a two-pawl locking mechanism with the comfort pawl 2 and the pawl 3. The locking mechanism may also be a conventional locking mechanism consisting of the catch 1 and only one pawl 3; this is not illustrated, however.

In addition to the locking mechanism or two-pawl locking mechanism, the depicted motor vehicle latch also has an operating lever mechanism for the locking mechanism. The operating lever mechanism in the figures depicted is composed of an actuating lever 4, a coupling lever 5, and a release lever 6.

The actuating lever 4 may be mechanically connected to an outer actuating lever or an inner actuating lever, which is not shown in detail, however. Just one arrow 7 is shown in FIGS. 1A and 1 B, and it indicates that the actuating lever 4 must be acted upon in the direction of the arrow 7 in the normal operation depicted in FIGS. 1A and 1B in order to be able to open the locking mechanism 1, 2, 3, depicted in the locked state.

The front view according to FIG. 1 B shows that the action on the actuating lever 4 in the direction of the arrow 7 leads to the actuating lever 4 performing a clockwise movement. The rear view according to FIG. 1A depicts a counterclockwise movement, also indicated, corresponding thereto. In any case, the pivot movement of the actuating lever 4 about its axis 8, this pivot movement being connected to an opening process for the locking mechanism, ensures that the actuating pin 9 of the coupling lever 5, which is "coupled" during normal operation, abuts a support surface 10 of the release lever 6 or moves against this support surface 10 of the release lever 6.

Figure 1B:
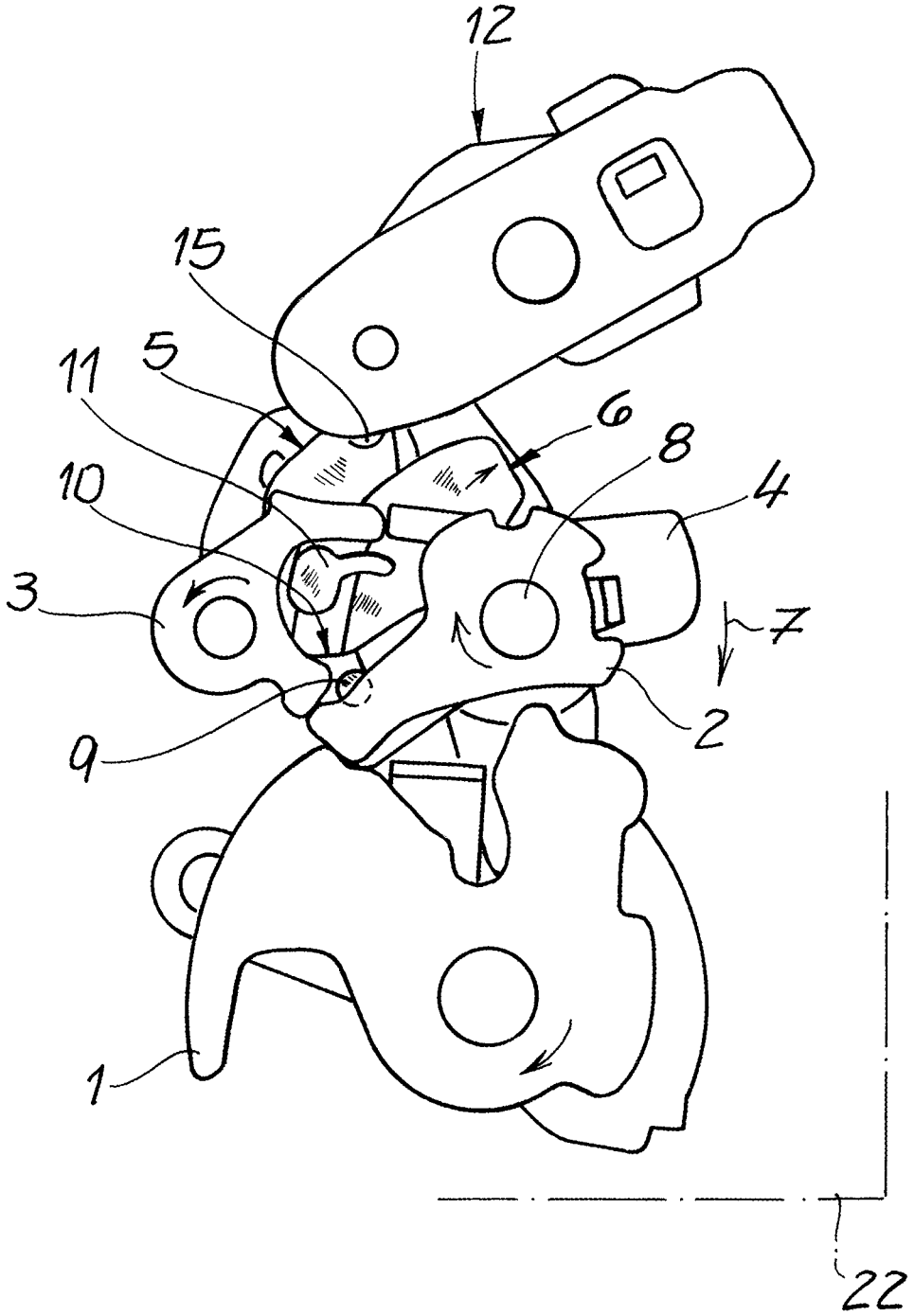

In this way the actuating contour 11 of the release lever 6 ensures overall that the pawl 3 securing the comfort pawl 2 is pivoted counterclockwise (in the front view according to FIG. 1B). The consequence of this is that the comfort pawl 2 (spring-loaded) may release from the catch 1 and pivots upward in the clockwise direction indicated in the depiction according to FIG. 1B. Now the catch 1 is free and can, for its part (using spring force) pivot upward in the clockwise direction and release a previously captured locking bolt (not shown). The associated motor vehicle door may be opened (see the arrow in FIG. 1B).

If there is now a crash event, the coupling lever 5, which in normal operation is "coupled," transfers to its "uncoupled" position. While the coupling lever 5 in its "coupled" position mechanically connects the release lever 6 to the locking mechanism in normal operation, and in this manner permits the locking mechanism to be opened using the operating lever mechanism, the "uncoupled" position of the coupling lever 5 corresponds to the release lever 6 being separated from the locking mechanism. The crash event corresponds to this and will be described in greater detail in the following and is depicted in FIGS. 2, 3, and 4.

Figure 2:
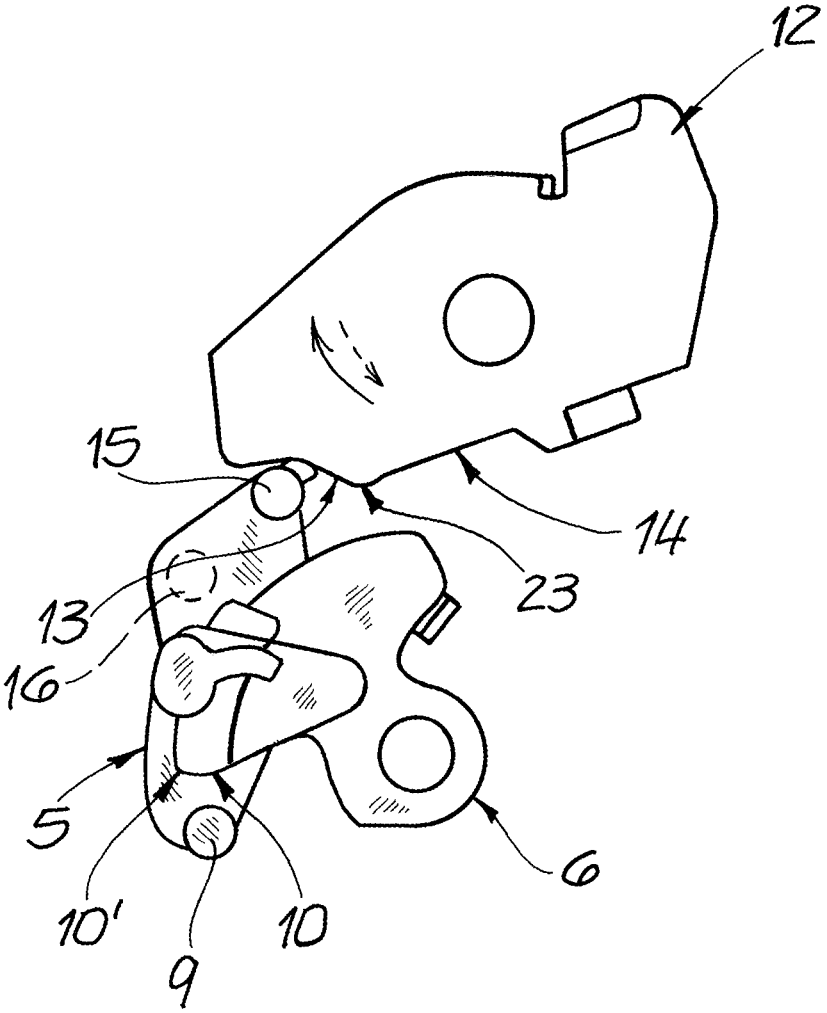
FIG. 2 depicts the motor vehicle latch according to FIG. 1 in a crash event; and, FIGS. 3 and 4 are each detail views of the subject matter according to FIG. 2.
Figure 3:
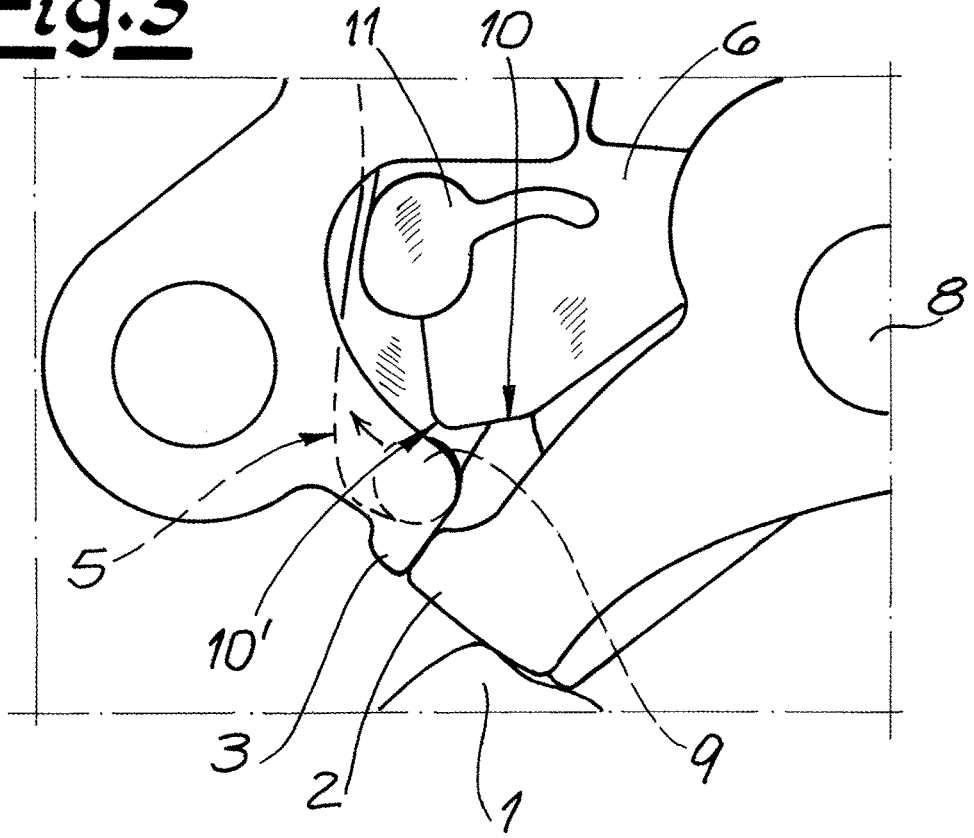
Figure 4:
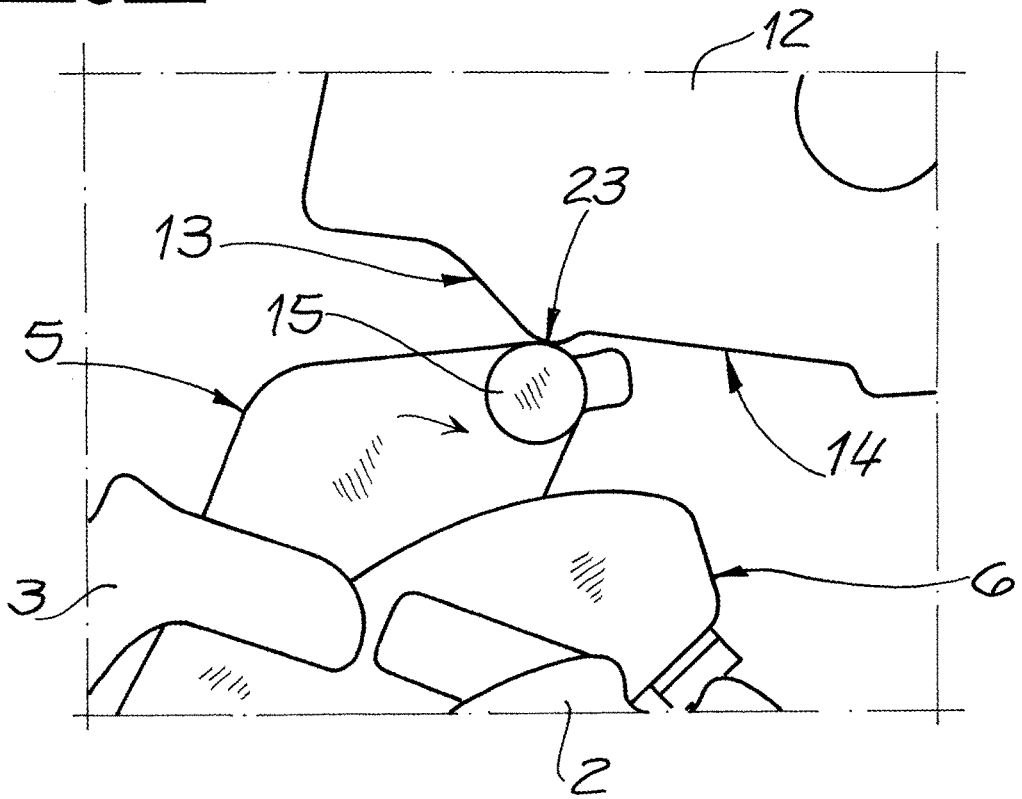

In the exemplary embodiment, provided for guiding the coupling lever 5 is an inertia element 12 that may be seen most easily in FIGS. 2 and 4, where the components of the motor vehicle latch that are essential for the crash event are depicted separately. In fact, the inertia element 12 overall has a guide contour for the coupling lever 5. According to the exemplary embodiment, a contour pin 15 on the coupling lever 5 interacts with the guide contour on the inertia element 12.

When FIGS. 1A and 1 B are compared to the depiction in FIG. 2, it may be seen that the coupling lever 5 is equipped on its one side with the aforesaid actuating pin 9, which interacts with the support surface 10 on the release lever 6, and on its other side with the contour pin 15, already addressed. On the other side of the coupling lever 5 in question, a pivot pin 16 and a spring journal 17 are also provided on the coupling lever 5. The coupling lever 5 is rotatably mounted on the actuating lever 4. This is assured by a pivot pin 16 on the coupling lever 5 that engages in a bearing opening. In contrast, both the contour pin 15 and the spring journal 17 on the coupling lever 5 engage in a guide contour 18 on the actuating lever 4 and in this manner ensure guidance of the coupling lever 5, which is pivotable relative to the actuating lever 4.

According to the invention, the design overall is such that the guide contour on the inertia element 12 ensures that in the crash event depicted in FIGS. 2 and 4 the coupled coupling lever 5 is separated from the release lever 6 and, without further mechanical contact to the release lever 6, is transferred to its "uncoupled" position. An actuating spring 19 associated with the coupling lever 5 is realized to support the transition of the coupled coupling lever 5 in its "uncoupled" position. The actuating spring 19 has a wound section 19*a* that winds around a pivot pin on the actuating lever 4, which at the same time defines its axis of rotation 8.

Moreover, the actuating spring 19 embodied as leg spring has a fixing leg 19*b* and a clamping leg 19*c*. Using the fixing leg 19*b*, the actuating spring or leg spring 19 is connected to the actuating lever 4 for acting on the coupling lever 5. In contrast, the clamping leg 19*c* is free and in this manner may act on the aforesaid spring journal 17 on the coupling lever 5 and thus on the coupling lever 5 overall. The action of the actuating spring 19 occurs in that the coupling lever 5 is pre-stressed towards the guide contour on the inertia element 12.

In addition to the actuating spring 19, a restoring spring 20 is also provided. The restoring spring 20 is also embodied as a leg spring. The restoring spring or leg spring 20 has a wound section 20*a* that surrounds a bearing journal 21 of the inertia element 12 with clearance. Using the bearing journal 21, the inertia element 12 is rotatably mounted in a latch housing or latch box 22. The same is true of the locking mechanism, as well as the actuating lever 4 and the release lever 6. In contrast, the coupling lever 5, as described, is mounted on the actuating lever 4 using its pivot pin 16.

In addition to the wound section 20*a*, the restoring spring or leg spring 20 has two legs 20*b* and 20*c*. The leg 20*b* of the restoring spring 20 is locationally fixed in the latch housing or latch box 22. In contrast, the free leg 20*c* of the restoring spring 20 is supported on the inertia element 12 and ensures overall that, in a crash event, after the deceleration forces have ceased, the inertia element 12 is transferred from its deflected position, indicated in FIGS. 2 and 4, back to its undeflected position, depicted in FIGS. 1A and 1B.

Functioning is as follows. In normal operation according to FIGS. 1A and 1B, the coupling lever 5 is in its "coupled" position. In this position, the actuating pin 9 of the coupling lever 5 abuts the support surface 10 of the release lever 6 or moves against the support surface 10 when an opening action is performed on the actuating lever 4. This opening action by the actuating lever 4 may occur, for example, by acting upon the actuating lever 4 in the direction of the arrow 7, and, corresponds to the aforesaid movement of the actuating lever 4, clockwise in the front view according to FIG. 1B.

The result of the clockwise movement of the actuating lever 4 is that the actuating pin 9 of the coupling lever 5 rotatably mounted on the actuating lever 4 acts on the support surface 10 of the release lever 6 and thus the release lever 6 also experiences a clockwise rotation. The rotation occurs with respect to the common rotational axis 8 of the actuating lever 4 and of the release lever 6. This is of course only an example and is not limiting (see FIG. 1B).

Because of the clockwise rotation of the release lever 6, the release lever 6, with the actuating contour 11, works on the pawl 3 and pivots the latter counterclockwise, as depicted in FIG. 1B, so that immediately following this the comfort pawl 2 previously secured using the pawl 3 pivots upward in the clockwise direction and releases the catch 1 as described, together with the striker. The associated motor vehicle door may be opened in the described normal operation (see FIG. 1B).

If there is then the crash event depicted in FIGS. 2, 3, and 4, the actuating lever 4, and with it the coupling lever 5, are deflected. The deflection movement of the coupling lever 5 occurs guided by the two pins 15, 17 within the guide contour 18 on the actuating lever 4. During this process, therefore, the actuating lever 4 and also the coupling lever 5, which is rotatably mounted relative to the actuating lever 4, move together.

Consequently, the contour pin 15 on the coupling lever 5 slides along the guide contour of the inertia element 12. At the beginning of the crash event, the inertia element 12 initially remains in its undeflected position or rest position depicted according to FIGS. 1A, 1B. During the crash event, and as the acceleration forces increase, the inertia element 12 is deflected and assumes its deflected position in FIG. 2. This occurs against the force of the restoring spring 20, which, after the deceleration forces cease and the crash event has concluded, ensures that the inertia element 12 is returned to its undeflected position. Arrows in FIG. 2 indicate this. The solid arrow indicates the movement of the deflected inertia element 12 in the crash event, while the dotted arrow represents the restoring movement into the undeflected position using the restoring spring 20.

The deflection of the coupling lever 5 with respect to the actuating lever 4 or together with the actuating lever 4 pivoted in the crash event now leads to the contour pin 15 on the coupling lever 5 interacting with the aforesaid guide contour on the inertia element 12. In fact, the guide contour is composed of a lifting flank 13, on the one hand, and a support region 14, on the other hand. At the beginning of the crash event, and during a clockwise pivot movement of the coupling lever 5, the contour pin 15 of the coupling lever 5 moves against the lifting flank 13, as indicated in FIG. 4.

The interaction between the contour pin 15 of the coupling lever 5 and the obliquely inclined lifting flank 13 on the inertia element 12 now leads to the coupling lever 5, in the depiction according to FIG. 4, being increasingly pivoted clockwise about its rotational axis, which is defined by the pivot pin 16, with respect to the actuating lever 4 until the contour pin 15 reaches the support region 14 as a further component of the guide contour on the inertia element 12. In this process, the contour pin 15 also traverses an elevation 23 separating the lifting flank 13 from the support region 14. In any case, the interaction between the contour pin 15 and the lifting flank 13 overall ensures that the coupling lever 5 is not just transferred to the "uncoupled" position from its coupled position.

Instead, at the same time the coupled coupling lever 5 transitions to the "uncoupled" position, the actuating pin 9 is guided along the support surface 10 of the release lever 6, and in particular an end-face edge 10' of the support surface 10, specifically with clearance, as FIG. 3 clearly illustrates. In this way, during the transition of the coupling lever 5 from its "coupled" position to the "uncoupled" position, there is overall no further mechanical contact with the release lever 6. That is, the transition from the coupled position of the coupling lever 5 to the "uncoupled" position occurs controlled merely by the mechanical interaction between the contour pin 15 and the guide contour on the inertia element 12. Otherwise the coupling lever 5 may move freely mechanically.

As soon as the coupling lever 5 has assumed its "uncoupled" position, the actuating pin 9 on the coupling lever 5 is free from the support surface 10 on the release lever 6 and can also not interact any longer with said support surface 10. In the crash event described, therefore, the locking mechanism 1, 2, 3 retains its locked position illustrated in FIGS. 1A and 1B. Unintentional opening of the latch is consequently not possible, because the support surface 10, and with it the release lever 6 bearing it, are not acted upon.

The interaction between the contour pin 15 of the coupling lever 5 and the guide contour on the inertia element 12 is also retained and continued when the inertia element 12 is moved slightly from its undeflected position into the deflected position as the result of deceleration forces acting thereon. This is because this process merely leads to the contour pin 15 on the coupling lever 5 striking areas of the lifting flank 13 that are oriented closer to the elevation 23. This does not change anything about the pivot movement of the coupling lever 5, realized by the lifting flank 13, during the transition from its "coupled" position to the "uncoupled position." In all of these cases, the pivot movement is always selected and designed such that the actuating pin 9 is guided, with clearance, with respect to the support surface 10 and in particular its edge 10', so that after the actuating pin 9 has been lifted relative to the support surface 10 there is no further mechanical contact, nor can there be any further mechanical contact, between the coupling lever 5 and the release lever 6 (see FIG. 4).

REFERENCE LIST

1 Catch
2 Comfort pawl
3 Pawl
4 Actuating lever
5 Coupling lever
6 Release lever
7 Arrow/direction of arrow
8 Axis
9 Actuating pin
10 Support surface
10' End-face edge
11 Actuating contour
12 Inertia element
13 Lifting flank
14 Support region
15 Contour pin
16 Pivot pin
17 Spring journal
18 Guide contour
19 Actuating spring/leg spring
**19*a*** Wound section
**19*b*** Fixing leg
**19*c*** Clamping leg
20 Restoring spring/leg spring

20*a* Wound section
20*b* Leg
20*c* Free leg
21 Bearing journal
22 Lock housing/lockbox
23 Elevation

The invention claimed is:

1. A motor vehicle latch comprising:

a locking mechanism having a catch and at least one pawl;

an operating lever mechanism for the locking mechanism with a coupling lever and one release lever mechanically connected to the locking mechanism, wherein the coupling lever has a coupled position in which the coupling lever is mechanically connected to the release lever for unlocking the locking mechanism, and an uncoupled position in which the coupling lever is separated from the release lever for retaining the locking mechanism in a locked position; and an inertia element for guiding the coupling lever, wherein the inertia element has a guide contour for the coupling lever, wherein during a crash event, the guide contour separates the coupling lever, which is in the coupled position, from the release lever and, without further mechanical contact, transfers the coupling lever to the uncoupled position, wherein the guide contour on the inertia element has a lifting flank for a contour pin of the coupling lever that guides an actuating pin of the coupling lever interacting with a support surface on the release lever during the transition of the coupling lever from the coupled position to the uncoupled position on the support surface of the release lever with clearance.

2. The motor vehicle latch according to claim 1 further comprising an actuating spring that pre-stresses the coupling lever towards the guide contour on the inertia element.

3. The motor vehicle latch according to claim 2, wherein the actuating spring is a leg spring having a fixing leg and a clamping leg.

4. The motor vehicle latch according to claim 3, wherein the fixing leg is fixed on an actuating lever, while the clamping leg acts on the coupling lever.

5. The motor vehicle latch according to claim 1 further comprising a restoring spring that acts on the inertia element in a direction of an undeflected position of the inertia element.

6. The motor vehicle latch according to claim 5 further comprising a bearing journal about which the restoring spring is pivotable, wherein the restoring spring surrounds the bearing journal.

7. The motor vehicle latch according to claim 5, wherein the restoring spring has one leg that is anchored in a lock housing and a free leg that acts on the inertia element.

8. The motor vehicle latch according to claim 1, wherein the operating lever mechanism includes an actuating lever on which the coupling lever is rotatably arranged.

9. The motor vehicle latch according to claim 8, wherein the coupling lever engages with at least one pin in a guide contour of the actuating lever.

10. The motor vehicle latch according to claim 9, wherein the at least one pin includes a spring journal and a contour pin, are provided on the coupling lever that, to guide it, jointly engage in the guide contour on the actuating lever.

11. The motor vehicle latch according to claim 10, wherein the spring journal interacts with an actuating spring and the contour pin interacts with the guide contour on the inertia element.

12. The motor vehicle latch according to claim 11, wherein the actuating spring has a wound section that winds around an axis of rotation of the actuating lever.

13. The motor vehicle latch according to claim 1, wherein the coupling lever has an actuating pin on one side that engages the release lever and a pivot pin on a side that is opposing the one side.

14. The motor vehicle latch according to claim 13, wherein the coupling lever has a contour pin that is arranged opposite the actuating pin.

15. The motor vehicle latch according to claim 1, wherein the lifting flank is obliquely inclined.

16. The motor vehicle latch according to claim 1, wherein the contour pin traverses an elevation separating the lifting flank from the support region.

17. The motor vehicle latch according to claim 1, wherein the actuating pin is guided along an end-face edge of the support surface with clearance.

18. A motor vehicle latch comprising:

a locking mechanism having a catch and at least one pawl;

an operating lever mechanism for the locking mechanism with a coupling lever and one release lever mechanically connected to the locking mechanism, wherein the coupling lever has a coupled position in which the coupling lever is mechanically connected to the release lever for unlocking the locking mechanism, and an uncoupled position in which the coupling lever is separated from the release lever for retaining the locking mechanism in a locked position;

an inertia element for guiding the coupling lever, wherein the inertia element has a guide contour for the coupling lever, wherein during a crash event, the guide contour separates the coupling lever, which is in the coupled position, from the release lever and, without further mechanical contact, transfers the coupling lever to the uncoupled position; and an actuating spring that pre-stresses the coupling lever towards the guide contour on the inertia element, wherein the actuating spring is a leg spring having a fixing leg and a clamping leg, and wherein the fixing leg is fixed on an actuating lever, while the clamping leg acts on the coupling lever.

19. A motor vehicle latch comprising:

a locking mechanism having a catch and at least one pawl;

an operating lever mechanism for the locking mechanism with a coupling lever and one release lever mechanically connected to the locking mechanism, wherein the coupling lever has a coupled position in which the coupling lever is mechanically connected to the release lever for unlocking the locking mechanism, and an uncoupled position in which the coupling lever is separated from the release lever for retaining the locking mechanism in a locked position; and an inertia element for guiding the coupling lever, wherein the inertia element has a guide contour for the coupling lever, wherein during a crash event, the guide contour separates the coupling lever, which is in the coupled position, from the release lever and, without further mechanical contact, transfers the coupling lever to the uncoupled position, wherein the operating lever mechanism includes an actuating lever on which the coupling lever is rotatably arranged, wherein the coupling lever engages with at least one pin in a guide contour of the actuating lever, and wherein the at least one pin includes a spring journal and a contour pin, are provided on the coupling lever that, to guide it, jointly engage in the guide contour on the actuating lever.

* * * * *